US006132227A

United States Patent [19]

Boteler et al.

[11] Patent Number: 6,132,227

[45] Date of Patent: Oct. 17, 2000

[54] RECEPTACLE ASSEMBLY WITH IMPROVED ENCLOSURE

[75] Inventors: William C. Boteler, Bridgeport, Conn.; Michael W. Miller, St. Louis, Mo.

[73] Assignee: Hubbell Incorporated, Orange, Conn.

[21] Appl. No.: 09/145,801

[22] Filed: Sep. 2, 1998

[51] Int. Cl.[7] ..... H01R 13/44

[52] U.S. Cl. ..... 439/142; 439/136

[58] Field of Search ..... 439/142, 136, 439/135, 148, 320, 488; 220/296, 810, 830, 833

[56] References Cited

U.S. PATENT DOCUMENTS

| | | | |
|---|---|---|---|
| 3,633,150 | 1/1972 | Swartz | 339/36 |
| 3,950,055 | 4/1976 | Samuela et al. | 339/44 R |
| 4,381,879 | 5/1983 | Ehrenfels et al. | 339/44 R |
| 4,902,238 | 2/1990 | Iacobucci | 439/135 |
| 5,417,350 | 5/1995 | Koo | 222/556 |
| 5,571,023 | 11/1996 | Anthony | 439/142 |
| 5,573,412 | 11/1996 | Anthony | 439/133 |
| 5,582,521 | 12/1996 | Mori et al. | 439/142 |
| 5,588,853 | 12/1996 | Anthony | 439/136 |
| 5,722,847 | 3/1998 | Haag | 439/320 |

*Primary Examiner*—Lincoln Donovan
*Assistant Examiner*—Chandrika Prasad
*Attorney, Agent, or Firm*—Jerry M. Presson; Michael R. Swartz

[57] ABSTRACT

A receptacle assembly having a body and a hinged cover is provided to accept a plug with a threaded ring connector. The body has an open end, an exterior surface and a ridge formed on the exterior surface adjacent to the open end adapted to receive the threaded ring of the plug. The ridge of the body has at least one interruption and defines threads for engagement with the threaded ring on the plug. The hinged cover has an interior periphery and at least one protrusion formed on the interior periphery and alignable with the one interruption of the ridge and movable through the interruption and into an underlying position relative to the ridge such that the cover is securely fitted over the open end of and onto the body when the assembly is not in use by moving the cover toward the body followed by rotating the cover relative to the body. The ridge has at least one protrusion engagement portion defined by a side edge adjacent to and bounding one side of the one interruption, a lower edge extending in substantially perpendicular relation to the side edge and an inclined edge extending downwardly from the side edge to the lower edge such that the one protrusion is movable from an open position through the interruption down the inclined edge into the underlying position and into an increasingly secure position relative to the ridge to a closed sealed position against the lower edge. When the plug is removed from the receptacle, the cover automatically snaps shut over the open end of the body. The assembly further includes a compressible gasket mounted to and held loosely against an interior surface of the cover and is prevented from falling away from the cover by the one protrusion of the cover. The gasket is compressed as the one protrusion moves into the underlying position relative to the ridge of the body.

16 Claims, 4 Drawing Sheets

RECEPTACLE ASSEMBLY WITH IMPROVED ENCLOSURE

CROSS REFERENCE TO RELATED APPLICATION

Reference is hereby made to the following copending U.S. applications dealing with subject matter related to the present invention: "Receptacle Assembly Having Position Retention Tabs" by Douglas A. Hopper, assigned U.S. Ser. No. 09/033,298 and filed Mar. 2, 1998, "Receptacle Assembly With Cover Position Indicating Means" by Michael W. Miller, assigned U.S. Ser. No. 09/145,800 and filed Sep. 2, 1998, which has issued into U.S. Pat. No. 5,951,309, which are assigned to the same assignee as this application.

BACKGROUND OF THE INVENTION

1. Field of the Invention

The present invention generally relates to electrical connectors of the type having plug and receptacle components for general and hazardous industrial applications and, more particularly, is concerned with a receptacle assembly having an improved enclosure for accepting a plug having a threaded ring connector.

2. Description of the Prior Art

For many years a comprehensive selection of electrical products, namely, electrical fittings, enclosures, distribution equipment, connectors, controls and lighting fixtures, have been manufactured and sold by Killark Electric Manufacturing Company, a subsidiary of Hubbell Incorporated. These electrical products are designed for use in hazardous, hostile, corrosive and general industrial environments. More specifically, weather resistant electrical connectors having plugs and receptacles are designed as general purpose equipment for use in and around industrial plants, both indoors and outdoors, on portable and stationary apparatuses. The majority of the components of these electrical connectors, the plugs and receptacles, are joined or connected to one another by mateable threads or locking lugs as well known to those skilled in the art.

Commonly, an electrical connector receptacle has a body which is adapted to receive a plug at one end and a cover which is used to close the body when the plug is removed and the receptacle is not in use. In closing the body, the cover engages and seals the open end of the receptacle preventing water from entering the body and contacting any electrical connections within the receptacle. One type cover has threads and threadably screws onto the body whereas another type of cover has lugs that locks the cover on the body. The cover is typically provided with a gasket and is attached to the body by means of a lanyard, chain, hinge or the like so that the cover cannot be misplaced when the receptacle is not in use.

Problems exist, however, in the prior art designs. With the threaded covers, many turns are required to screw the cover down onto the body and against the gasket so as to provide a tight fit. The tediousness of screwing on the cover frequently results in the cover being left open in the case of hinge attached covers, not being screwed on tightly, or left hanging from the receptacle in the case of lanyard or chain attached covers. Also, the internal threads of the cover and/or the external threads of the body can become damaged during engagement and use of the receptacle. And with regards to receptacles having locking lug type covers, they do not accept plugs that are connected with threaded rings.

Consequently, a need still exists for a receptacle assembly which provides a solution to the aforementioned problems in the prior art without introducing any new problems in place thereof.

SUMMARY OF THE INVENTION

The present invention provides a receptacle assembly designed to satisfy the aforementioned need. The receptacle assembly of the present invention accepts plugs having threaded ring connectors and allows an electrician to tightly close and seal a cover of the assembly onto an open end of a body of the assembly when the plug is removed from the assembly. The tight seal is achieved by only a small rotation of the cover on the body. The achievement of the tight seal does not involve the employment of threads and so the electrician need not be concerned about damage to threads which may occur in the process of engagement of the cover and body and use of the assembly. Furthermore, the cover is provided with a detent relative to the hinge such that when it is opened, it tends to remain in a position where the lugs will freely pass through the interruptions provided in the threads of the ridge. Consequently, once the cover is opened and the plug is removed from the receptacle, the cover will snap closed with the gasket in sealing relationship with the face of the body of the receptacle.

Accordingly, the present invention is directed to a receptacle assembly which comprises: (a) a body having an open end, an exterior surface and a ridge formed on the exterior surface adjacent to the open end, the ridge having at least one interruption defined therein, the body being adapted to receive a plug at the open end; and (b) a cover having an interior periphery and at least one protrusion formed on the interior periphery and being alignable with the one interruption of the ridge of the body and movable through the one interruption and into an underlying position relative to the ridge of the body, upon movement of the cover toward the body followed by rotation of the cover relative to the body, to thereby securely fit the cover over the open end of and onto the body when the assembly is not in use.

More particularly, the ridge of the body has threads formed thereon for engagement with a threaded ring on the plug when the cover is removed from the body and the assembly is in use. The body and cover both have substantially cylindrical configurations with the diameter of the cover being slightly greater than the diameter of the body for fitting the cover over the open end of and onto the body. The cover also has a top wall and a side wall attached to and extending about and outwardly from a periphery of the top wall and defining the interior periphery of the cover. The top wall and peripheral side wall form interior surfaces on the cover. The protrusion is formed on the peripheral side wall and extends inwardly from the interior surface of the side wall such that in cross-section the top wall periphery and the peripheral side wall together with the protrusion have a substantially J-shaped or hook-like configuration. The ridge of the body has at least one protrusion engagement portion defined by a side edge disposed adjacent to and bounding one side of the interruption of the ridge, a lower edge extending in substantially perpendicular relation to the side edge and an inclined edge extending downwardly from the side edge to the lower edge such that the protrusion is movable from an open position in the interruption down the inclined edge in the underlying position and into an increasingly secure position relative to the ridge to a closed sealed position against the lower edge as the cover is rotated relative to the body.

The assembly further comprises a gasket mounted to the interior surface of the top wall of the cover. The gasket is held loosely against the interior surface of the top wall of the cover and is prevented from falling away from the cover by the presence of the at least one protrusion of the cover. The gasket has a substantially flat and circular configuration and a diameter slightly less than the diameter of the cover for fitting the gasket within the interior periphery of the cover. The gasket is comprised of a substantially compressible material such that the gasket becomes compressed as the protrusion moves into the underlying position relative to the ridge of the body.

The assembly further comprises a hinge pivotally mounting the cover to the body for undergoing movement between an open condition and a closed condition relative to the body and biasing the cover toward the closed condition such that the cover automatically closes the open end of the body as the connector plug is removed from the receptacle.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
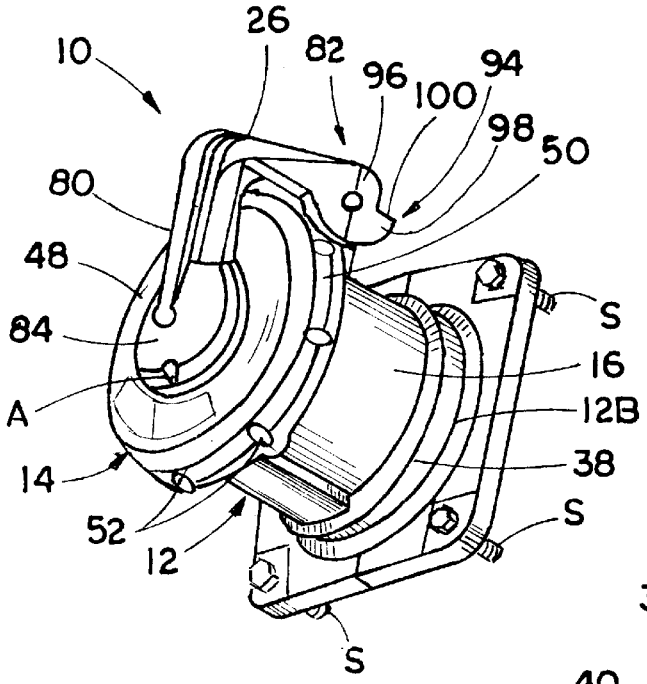
FIG. 1 is a perspective view of a receptacle assembly incorporating the features of the present invention, showing a cover of the assembly in a closed position.

In the following description, like reference characters designate like or corresponding parts throughout the several views of the drawings. Also in the following description, it is to be understood that such terms as "forward", "rearward", "left", "right", "upwardly", "downwardly" and the like are words of convenience and are not to be construed as limiting terms.

Referring now to the drawings and particularly to FIGS. 1 to 7, there is illustrated a receptacle assembly, generally designated 10, incorporating the features of the present invention. The receptacle assembly 10 basically includes a body 12 and a cover 14. The body 12 has an open end 12A, an exterior surface 16 and a ridge 18 formed on and projecting outwardly from the exterior surface 16 adjacent to the open end 12A. The ridge 18 has at least one and, preferably, a pair of gaps or interruptions 20 defined or formed therein. The body 12 is adapted to receive a plug (not shown) with a threaded connector ring (not shown) at the open end 12A which places the assembly 10 in normal use. The cover 14 has an interior periphery 22 and at least one and, preferably, a pair of lugs or protrusions 24 formed on the interior periphery 22. As clearly seen in FIGS. 2 and 6, the interior periphery 22 of the cover 14 is threadless, since there are no threads thereon between the protrusions 24. Each protrusion 24 is alignable with one of the interruptions 20 of the ridge 18 of the body 12 and then movable through the respective one interruption 20 upon movement of the cover 14 toward the open end 12A of the body 12. Following thereafter, each protrusion 24 is movable into an underlying position relative to the ridge 18 of the body 12 upon rotation of the cover 14 relative to the body 12. Such combination of movements ensures that the cover 14 will be securely fitted over the open end 12A of and onto the body 12 when the assembly 10 is not in use. The assembly 10 further includes a hinge 26 pivotally mounting the cover 14 to the body 12 for undergoing movement between an open condition and a closed condition relative to the body 12. The cover 14 is loosely mounted to the hinge 26 at its center of rotation so that it is permitted limited motion along the axis of its center of rotation and the axis of rotation is permitted to skew slightly relative to the hinge 26 so that the gasket 56 retained within the cover 14 will assume a coplanar relationship with the face of the body 12 when the cover 14 is closed on the body 12. The hinge 26 also incorporates suitable means for biasing the cover 14 toward the closed condition such that the cover 14 automatically closes over the open end 12A when the plug (not shown) is unconnected and removed from the receptacle 10.

Referring now to FIGS. 1 to 7 and 10, the body 12 of the assembly 10, more particularly, is substantially cylindrical in shape. The body 12 has the open end 12A at a top thereof and an opposite bottom open end 12B and defines a passageway 12C therethrough extending between the top and bottom open ends 12A, 12B. The body 12 may have a diameter at the top open end 12A larger than at the bottom open end 12B and of the same size as a diameter of the passageway 12C. The passageway 12C is provided for receiving any suitable electrical assembly (not shown), such as a socket or the like, for making any suitable or desired electrical connection with a plug (not shown) inserted through the top open end 12A. The body 12 has the exterior surface 16 and an interior surface 28. The interior surface 28 defines a pair of opposite recesses 30 for mounting a pair of ground straps 32 thereto. The ground straps 32 are each mounted by a ground strap rivet 34 to the body 12 toward a lower end thereof. The diameter of the bottom open end 12B is smaller than the diameter of the top open end 12A by virtue of an interiorly extending ledge 36 which narrows the passageway 12C at the bottom open end 12B. The exterior surface 16 has formed thereon the ridge 18 at a top thereof which surrounds and projects outwardly from the top open end 12A and an opposite bottom ridge 38 formed at a bottom thereof which surrounds and projects outwardly from the bottom open end 12B. The interruptions 20 are formed in the top ridge 18. The interruptions 20 are spaced 180 degrees apart from one another on opposite sides of the body 12. Preferably, the top ridge 18 defines threads 40 thereon for engagement with a threaded ring (not shown) on the plug (not shown). The top ridge 18 may also define smooth flat areas 42 interrupting the threads 40 on the top ridge 18. There is preferably a pair of flat areas 42 disposed adjacent to and on opposite sides of the body 12 from the recesses 30. The bottom ridge 38 may be smooth and uninterrupted. A generally rectangular shaped base or flange 44 is connected to and surrounds the body 12 at the bottom open end 12B and is provided with holes 46 at the corners of the flange 44. The flange 44 facilitates mounting the body 12 to a separate support structure (not shown). Mounting screws S are passed through respective ones of the holes 46 for mounting of the flange 44, and thereby for mounting of the entire assembly 10, to any desired location.

Referring now to FIGS. 1 to 14, the cover 14 of the assembly 10, more particularly, is substantially circular in shape. The cover 14 is rotatable between an open position, which permits the cover 14 to be removed from the body 12 for connection of the plug (not shown) to the body 12, and a closed position, where the cover 14 is secured onto the body 12. The cover 14 is in one or the other of the open and closed positions when the respective words "open" and "closed" formed thereon are aligned with a stationary arrowhead A on the hinge 26, as best seen in FIG. 4. The cover 14 has a diameter slightly greater than the diameter of the body 12 at the top open end 12A for fitting the cover 14 onto the body 12.

Figure 9:
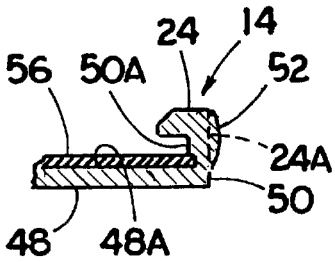
FIG. 9 is an enlarged fragmentary sectional view of the cover of the assembly taken along line 9—9 of FIG. 8.
Figure 10:
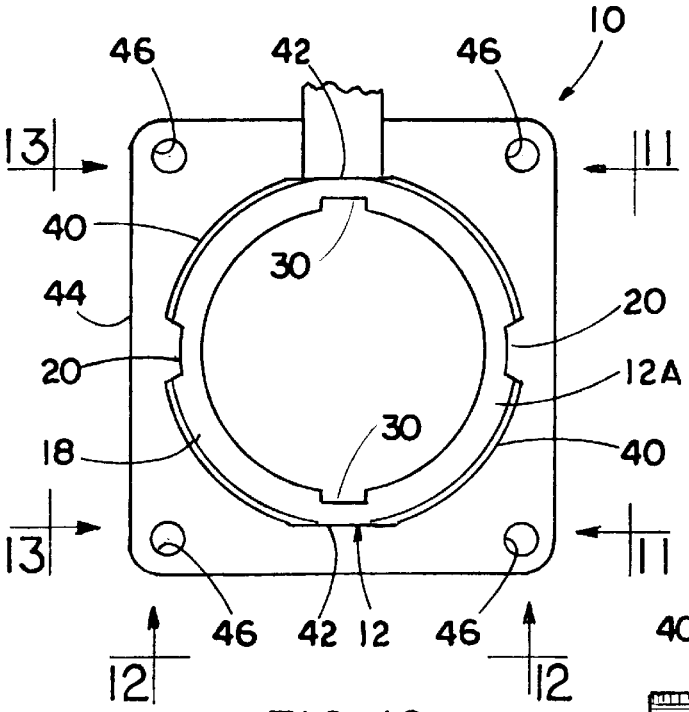
FIG. 10 is a top plan view of the body of the assembly showing a top ridge thereon having a pair of interruptions spaced about 180 degrees from one another.
Figure 11:
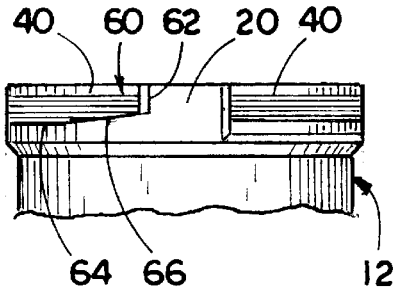
FIG. 11 is a side elevational view of the body of the assembly as seen along line 11—11 of FIG. 10 showing the top ridge of the body with one of the interruptions and having an inclined edge extending downwardly from a side edge adjacent to and bounding one side of the interruption to a lower edge of the ridge.
Figure 12:
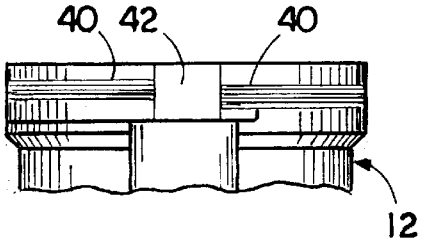
FIG. 12 is a front elevational view of the body of the assembly as seen along line 12—12 of FIG. 10.
Figure 13:
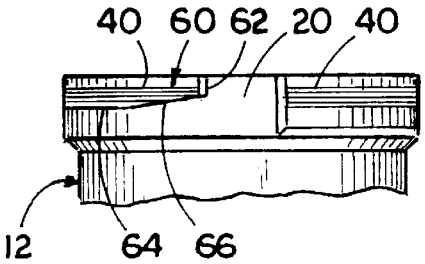
FIG. 13 is a side elevational view of the body of the assembly as seen along line 13—13 of FIG. 10 showing the opposite side of the body from that shown in FIG. 11.
Figure 14:
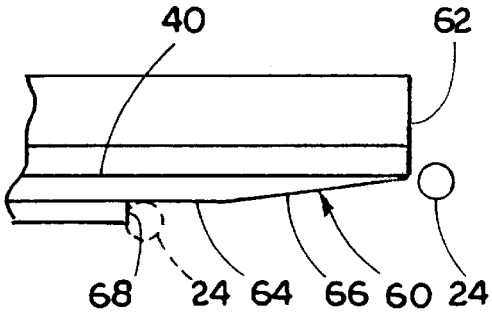
FIG. 14 is an enlarged detailed view of the top ridge of the body of the assembly showing one protrusion of the cover in an open position in solid line form at one end of the inclined edge of the ridge and the protrusion in a closed sealed position in dashed line form at the opposite end of the inclined edge of the ridge.

The interior periphery 22 of the cover 14 has the protrusions 24 which can be aligned with the interruptions 20 in the top ridge 18 on the exterior surface 16 of the body 12 and moved into the underlying position relative to the top ridge 18 of the body 12 when the cover 14 is rotated relative to the body 12 so as to retain the cover 14 in the closed position. The cover 14 has a top wall 48 and a side wall 50 which is continuous and is attached to and extends about and from the periphery 48A of the top wall 48 and defines the interior periphery 22 of the cover 14. The side wall 50 extends downwardly from the periphery 48A of the top wall 48 and defines the protrusions 24 interiorly therefrom. The side wall 50 also has a plurality of spaced apart gripping ridges 52 formed along an exterior surface thereof for aiding a user in rotating the cover 14. The top wall 48 of the cover 14 defines a central hole 54 used in mounting the cover 14 to the hinge 16. In cross-section as seen in FIG. 9, the top wall periphery 48A and peripheral side wall 50 together with each protrusion 24 have a substantially J-shaped or hook-like configuration facing interiorly toward an opposite side of the interior periphery 22 of the cover 14. The protrusions 24 are spaced 180 degrees apart from one another on opposite sides of the interior periphery 22 of the cover 14.

Figure 2:
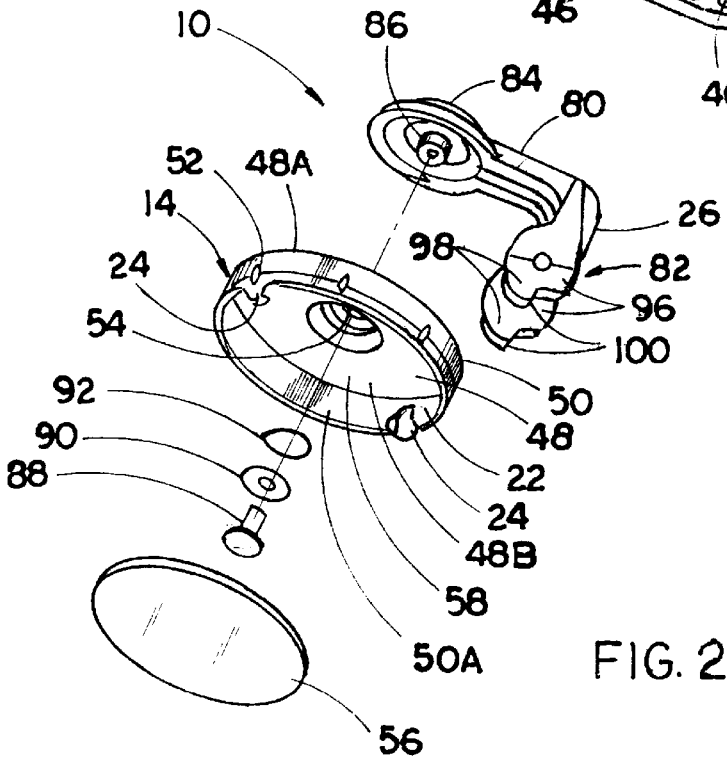
FIG. 2 is an exploded perspective view of the cover and a hinge of the receptacle assembly.
Figure 6:
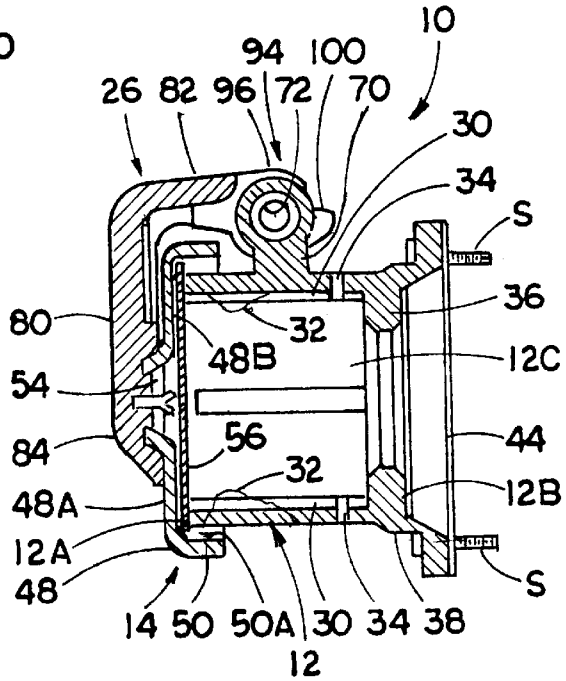
FIG. 6 is an axial sectional view of the assembly taken along line 6—6 of FIG. 4.
Figure 5:
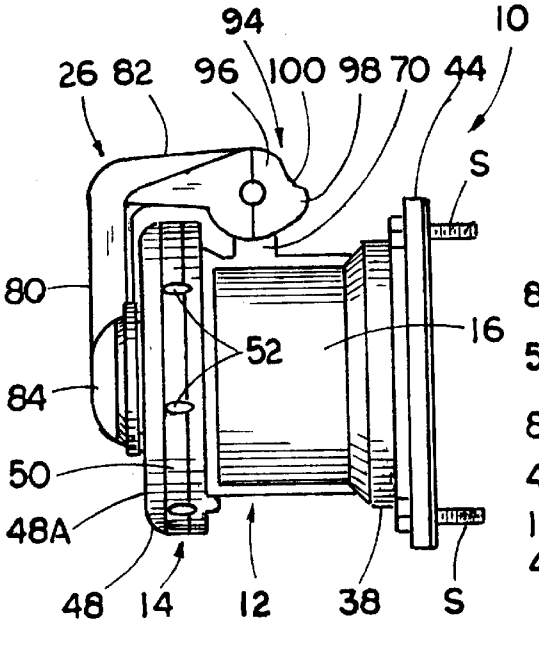
FIG. 5 is a side elevational view of the assembly as seen along line 5—5 of FIG.4.

The assembly 10 further includes a gasket 56, as best seen in FIGS. 2 and 9. The top wall 48 and side wall 50 together provide interior surfaces 48B and 50A which form an interior surface 58 on the cover 14. The gasket 56 is held loosely against the interior surface 48B of the top wall 48 of the cover 14 and is prevented from falling away from the cover 14 by the presence of protrusions 24 of the cover 14. The gasket 56 particularly abuts the protrusions 24 at a top end 24A thereof. The gasket 56 has a substantially flat and circular configuration and a diameter slightly less than the diameter of the cover 14 for fitting the gasket 56 within the interior periphery 22 of the cover 14. The gasket 56 is comprised of a substantially compressible material such that the gasket 56 will be compressed as the protrusions 24 move into the underlying position relative to the top ridge 18 of the body 12. The gasket 56 forms a seal between the cover 14 and the top open end 12A of the body 12 when the cover 14 is disposed in the closed position and condition relative thereto.

In its open position, the cover 14 is angularly displaced from the plug-receiving end of the body 12 allowing for mating of the plug (not shown) with the electrical assembly disposed within the body 12. In its closed position, with the plug removed from the body 12, the cover 14 engages and seals the top open end 12A of the body 12 so as to prevent water from entering any of the electrical connections within the body 12. The cover 14 is detented relative to the hinge 26 so that, after the plug is removed, the cover 14 automatically snaps closed to the position where it was at upon being opened due to the bias of the hinge 26 and the fact that the protrusions 24 are aligned with the interruptions 20 on the top ridge 18.

As best seen in FIGS. 8 to 14, the top ridge 18 of the body 12 has at least one and, preferably, a pair of protrusion engagement portions 60. Each protrusion engagement portion 60 is defined by a side edge 62 adjacent to and bounding a side of a respective one of the interruptions 20 of the top ridge 18, a lower edge 64 extending in substantially perpendicular relation to the side edge 62, and an inclined cam edge 66 extending downwardly from the side edge 62 to the lower edge 64 such that the respective one protrusion 24 is movable from an open position in the adjacent one of the interruptions 24 down the inclined cam edge 66 in the underlying position and into an increasingly secure position relative to the top ridge 18 to a closed sealed position against the lower edge 64 as the cover 14 is rotated relative to the body 12. The inclined cam edge 66 has a length greater than the length of the side edge 62 and greater than the length of the lower edge 64, though need not be so limited. The lengths of the side edge 62 and the lower edge 64 are approximately the same, though need not be so limited. The lengths and inclinations of the inclined cam edges 66 are such that only a fraction of a turn of the cover 14 is required to close the cover 14. The cover 14 is closed and sealed tightly onto the top open end 12A of the body 12 when a protrusion 24 is moved to an end of the lower edge 64 where an abutment 68 is defined by the top ridge 18. The gasket 56 is, more particularly, increasingly compressed as the protrusions 24 move down the inclined edges 66 into the underlying and increasingly secure positions relative to the top ridge 18 of the body 12. While the body 12 is shown with two protrusions 24 and the cover 14 is shown with two interruptions 20, they may have more than two.

Figure 3:
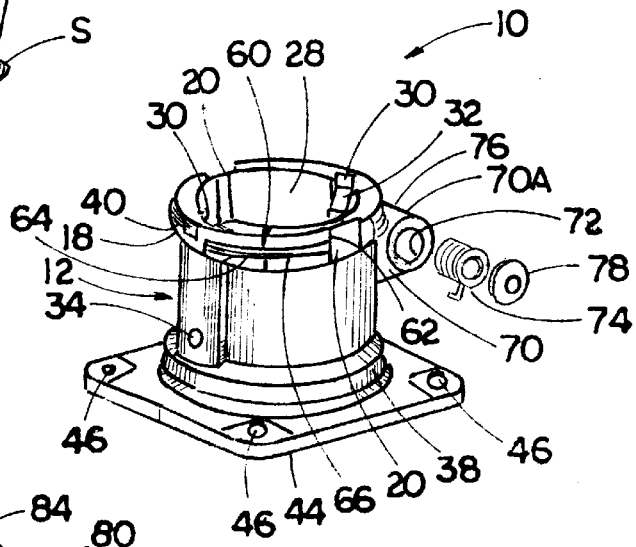
FIG. 3 is a perspective view of a body of the assembly showing a hinge mounting portion of the body exploded.
Figure 4:
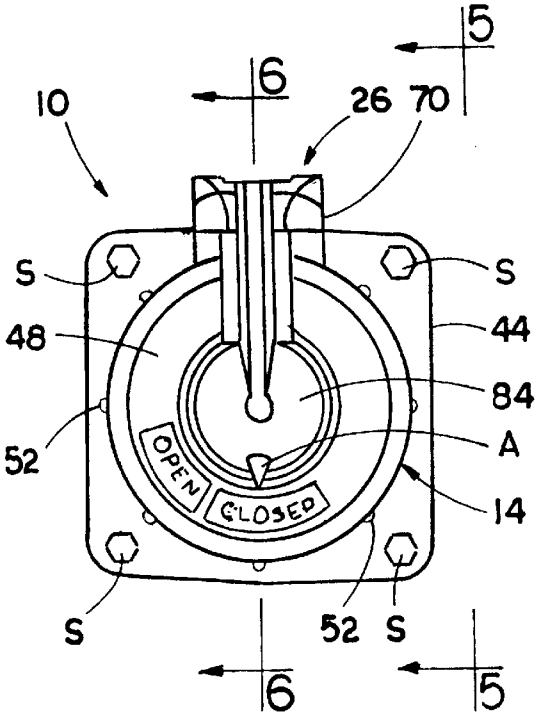
FIG. 4 is a top plan view of the assembly showing the cover in the closed position.
Figure 7:
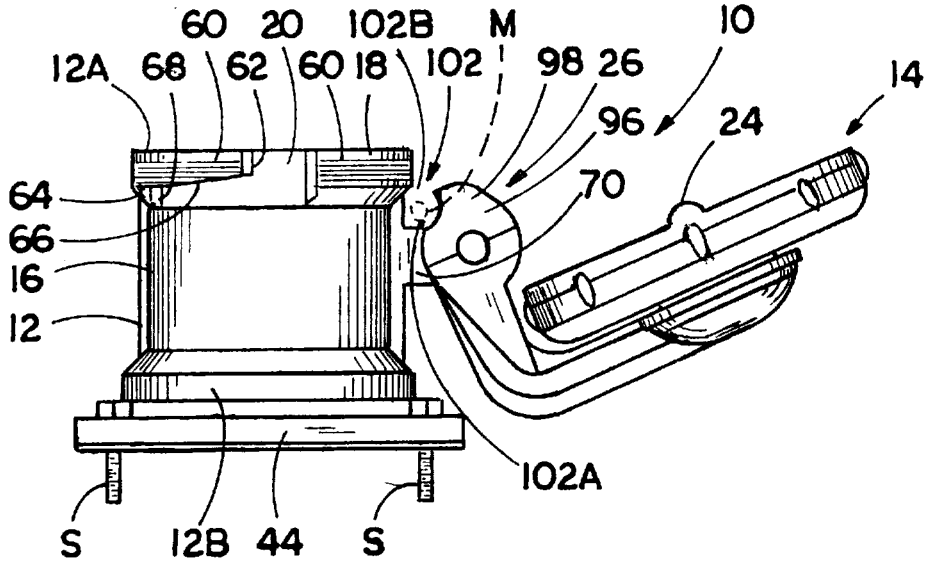
FIG. 7 is a side elevational view of the assembly similar to that of FIG. 5 but with the cover in an open position.
Figure 8:
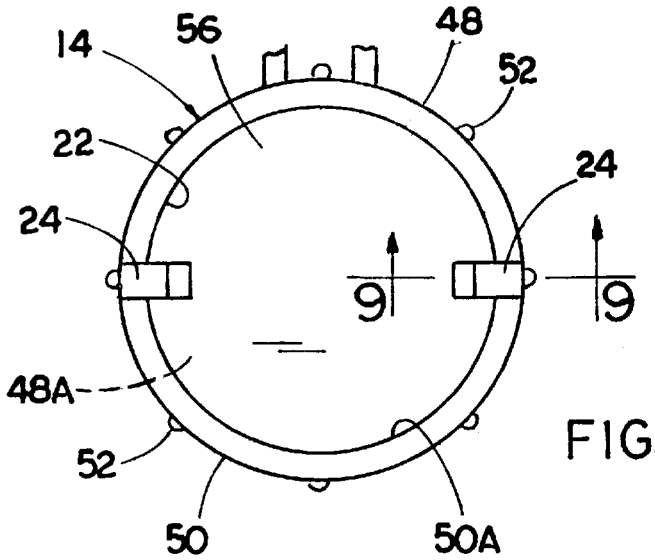
FIG. 8 is a bottom plan view of the cover of the assembly.

As best seen in FIG. 3, the body 12 further has a hinge mounting portion 70. The hinge mounting portion 70 is substantially cylindrical in shape and has an end 70A defining an open passageway 72 therethrough. The hinge mounting portion 70 preferably is integrally connected to and extends outwardly from the body 12 between and spaced from the top and bottom ridges 18, 38 (but closer to the top ridge 18) on the exterior surface 16 of the body 12. The hinge mounting portion 70 has a spring 74 disposed within the passageway 72 thereof which is operable with the hinge 26 for biasing the cover 14 to the closed condition. The spring 74 is coiled and can be disposed on a spring guide 76. A hinge bushing 78 is disposed around an end of the spring guide 76 between the spring 74 and a portion of the hinge 26. One end of the spring guide 76 can be knurled for securing that end of the spring guide 76 to the hinge 26.

As seen in FIGS. 1, 2, 5 and 7, the hinge 26 has a substantially L-shaped configuration with a pair of opposite upper and lower ends 80, 82. The upper end 80 is in the form of a substantially annular cap 84. The lower end 82 is bifurcated. The cap 84 is rotatably mounted to the top wall 48 of the cover 14. As best seen in FIG. 2, the cap 84 has a screw receptacle 86 formed on an underside thereof which is aligned with the central hole 54 of the top wall 48 of the cover 14. The cap 84 is then mounted to the top wall 48 of the cover 14 by a cover screw 88 inserted through a spring washer 90, a wave spring 92 and the central hole 54 of the top wall 48 of the cover 14 and into the screw receptacle 86 of the cap 84 of the hinge 26. The bifurcated end 82 of the hinge 26 defines a position retention means 94 which is the subject matter of the invention of the patent application cross-referenced above. The bifurcated end 82 of the hinge 26 preferably takes the form of a pair of spaced apart lugs 96 and the position retention means 94 takes the form of at least one and preferably a pair of tabs 98 laterally spaced apart from one another, each projecting peripherally outwardly from one of the lugs 96 and defining a shoulder 100 such that the shoulders 100 on the tabs 98 and the adjacent portion of the body 12 may retain a rod-shaped member M (not shown), such as a screwdriver or pencil, therebetween for holding the cover 14 adjacent to the open condition and blocking and preventing movement of the cover 14 from the open condition to the closed condition when the plug is not present at the top open end 12A of the body 12. The shoulders 100 preferably are relatively arcuate or concave in shape. The shoulders 100 generally face away from the body 12 when the cover 14 is located adjacent to its open condition. Also, the shoulders 100 in combination with the adjacent portion of the body 12 and the hinge mounting portion 70 form a channel-shaped gap 102 closed along a bottom 102A and open along a top 102B thereof for receiving and supporting the rod-shaped member M therein which, in turn, blocks pivotal movement of the hinge 26 and thereby the cover 14 to the closed condition.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

What is claimed is:

1. A receptacle assembly, comprising:

(a) a body having an open end, an exterior surface and a ridge formed on said exterior surface adjacent to said open end, said ridge having a plurality of adjacent external threads and at least one interruption defined through said external threads, said external threads of said body to receive at said open end a plug with an internally threaded connector ring by multiple turns of said ring on said body, said interruption through said external threads of said body adapted to receive at said open end of said body a plug with an internally lugged connector ring and mateably connect therewith by twisting of said ring on said body; and (b) a cover having a threadless interior periphery and at least one protrusion formed on said interior periphery and being alignable with said at least one interruption of said ridge of said body and movable through said one interruption and into an underlying position relative to said ridge of said body, upon movement of said cover toward said body followed by rotation of said cover relative to said body, to thereby securely fit said cover over said open end of and onto said body when said assembly is not in use.

2. The assembly as recited in claim 1, wherein said cover has a top wall and a side wall attached to and extending about and from a periphery of said top wall and defining said interior periphery of said cover, said top wall and side wall forming interior surfaces of said cover.

3. The assembly as recited in claim 2, wherein said at least one protrusion of said cover is formed on said side wall of said cover and extends inwardly from said interior surface thereof such that in cross-section said top wall periphery and said peripheral side wall together with said protrusion have a substantially J-shaped configuration.

4. The assembly as recited in claim 1, wherein said ridge of said body has at least one protrusion engagement portion defined by a side edge disposed adjacent to and bounding one side of said one interruption of said ridge, a lower edge extending in substantially perpendicular relation to said side edge and an inclined edge extending downwardly from said side edge to said lower edge such that said one protrusion is movable from an open position in said one interruption down said inclined edge in said underlying position and into an increasingly secure position relative to said ridge to a closed sealed position against said lower edge as said cover is rotated relative to said body.

5. The assembly as recited in claim 3, wherein:

said cover has a pair of said protrusions being spaced 180 degrees apart from one another on opposite sides of said interior periphery of said cover; and said assembly further comprises a gasket mounted to said interior surface of said cover, said gasket being held loosely against said interior surface of said cover and prevented from falling away from said cover by said pair of protrusions of said cover.

6. The assembly as recited in claim 5, wherein said cover has a substantially circular configuration and said gasket has a substantially flat and circular configuration and a diameter slightly less than a diameter of said cover for fitting said gasket within said interior periphery of said cover.

7. The assembly as recited in claim 1, further comprising:

a hinge pivotally mounting said cover to said body for undergoing movement between an open condition and a closed position relative to said body and biasing said cover toward said closed position.

8. A receptacle assembly, comprising:

(a) a body having an open end, an exterior surface and a ridge formed on said exterior surface adjacent to said open end, said ridge defining a pair of external protrusion engagement portions and a pair of circumferentially spaced external interruptions therebetween, each of said external protrusion engagement portions having a side edge disposed adjacent to and bounding a side of one of said interruptions, a lower edge disposed farther than said side edge from said open end and extending in substantially perpendicular relation to said side edge and an inclined edge extending away from said open end and downwardly from said side edge to said lower edge, said body to receive a plug at said open end; and (b) a cover having a threadless interior periphery and a pair of circumferentially spaced protrusions formed on said interior periphery and being alignable with said interruptions of said ridge of said body and movable from open positions through said interruptions past said side edges and then down said inclined edges of said protrusion engagement portions of said ridge of said body and into underlying positions relative to said ridge of said body, upon movement of said cover toward said body followed by rotation of said cover relative to said body, to place said protrusions into increasingly secure relation against said inclined edges as said protrusions move down said inclined edges to then underlie said lower edges of said protrusion engagement portions of said ridge of said body such that said cover is securely fitted and sealed over said open end of and onto said body when said assembly is not in use.

9. The assembly as recited in claim 8, wherein said ridge of said body has a plurality of adjacent threads formed thereon for engagement with an internally threaded ring on the plug and threadably connect therewith by multiple turns of said ring on said body when said cover is removed from said body as said assembly is in use.

10. The assembly as recited in claim 8, wherein said interruptions of said ridge of said body are circumferentially spaced about 180 degrees apart from one another on opposite sides of said body.

11. The assembly as recited in claim 10, wherein said protrusions of said cover are spaced 180 degrees apart from one another on opposite sides of said interior periphery of said cover.

12. The assembly as recited in claim 8, wherein said cover has a top wall and a side wall attached to and extending about and from a periphery of said top wall and defining said interior periphery of said cover, said top wall and side wall forming interior surfaces of said cover.

13. The assembly as recited in claim 12, wherein each of said protrusions of said cover is formed on said peripheral side wall of said cover and extends inwardly from said interior surface thereof such that in cross-section said top wall periphery and said peripheral side wall together with said protrusion have a substantially J-shaped configuration.

14. The assembly as recited in claim 8, wherein:

said cover has an interior surface; and said assembly further comprises a gasket mounted to said interior surface of said cover, said casket being held loosely against said interior surface of said cover and prevented from falling away from said cover by said pair of protrusions of said cover.

15. The assembly as recited in claim 14, wherein said cover has a substantially circular configuration and said gasket has a substantially flat and circular configuration and a diameter slightly less than a diameter of said cover for fitting said gasket within said interior periphery of said cover.

16. The assembly as recited in claim 8, further comprising:

a hinge pivotally mounting said cover to said body for undergoing movement between an open condition and a closed position relative to said body and biasing said cover toward said closed position.

* * * * *